US007360721B2

(12) United States Patent
Hofer

(10) Patent No.: US 7,360,721 B2
(45) Date of Patent: Apr. 22, 2008

(54) NOZZLE ASSEMBLY FOR A HIGH-PRESSURE CLEANING DEVICE

(75) Inventor: Thomas Hofer, Auenwald (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 277 days.

(21) Appl. No.: 11/145,511

(22) Filed: Jun. 2, 2005

(65) Prior Publication Data

US 2005/0263623 A1 Dec. 1, 2005

Related U.S. Application Data

(63) Continuation of application No. PCT/EP2003/012687, filed on Nov. 13, 2003.

(30) Foreign Application Priority Data

Dec. 11, 2002 (DE) ..... 102 57 783

(51) Int. Cl.
*A62C 31/00* (2006.01)

(52) U.S. Cl. ..... 239/437; 239/391; 239/438; 239/439; 239/440; 239/443; 239/456; 239/458; 239/581.2

(58) Field of Classification Search ..... 239/337–440, 239/442, 443, 456–458, 541, 581.1, 581.2, 239/391, 396
See application file for complete search history.

(56) References Cited

U.S. PATENT DOCUMENTS 4,095,747 A * 6/1978 Anderson ..... 239/288.5
4,789,104 A * 12/1988 Anderson ..... 239/455
5,242,116 A * 9/1993 Ronezzi ..... 239/438
6,016,975 A * 1/2000 Amaduzzi ..... 239/447

FOREIGN PATENT DOCUMENTS

| | | |
|---|---|---|
| DE | 196 13 391 | 10/1996 |
| EP | 0 146 795 | 7/1985 |
| EP | 0 501 164 | 9/1992 |
| EP | 0 638 366 | 2/1995 |
| EP | 1 254 719 | 11/2002 |

* cited by examiner

*Primary Examiner*—Kevin Shaver
*Assistant Examiner*—Jason Boeckmann
(74) *Attorney, Agent, or Firm*—Lipsitz & McAllister, LLC

(57) ABSTRACT

In order to achieve a particularly simple construction which is, in particular, easy to assemble in the case of a nozzle assembly for a high-pressure cleaning device with a low-pressure nozzle, a high-pressure nozzle arranged in it, a spray lance which bears a sealing pipe connection insertable into the high-pressure nozzle, a bypass surrounding the high-pressure nozzle and leading to the low-pressure nozzle and displacement elements which alter the distance between the sealing pipe connection and the high-pressure nozzle in such a manner that the sealing pipe connection abuts sealingly on the high-pressure nozzle in a high-pressure position and, as a result, interrupts the connection from the spray lance to the bypass whereas, in a low-pressure position, the sealing pipe connection is at a distance from the high-pressure nozzle and, as a result, releases the connection from the spray lance to the bypass, it is suggested that the spray lance bear a pot-shaped housing which surrounds the sealing pipe connection and in which the low-pressure nozzle and the high-pressure nozzle are mounted so as to be freely displaceable and sealed in relation to the inner wall of the housing and that the displacement elements displace the low-pressure nozzle and the high-pressure nozzle in the housing in its longitudinal direction towards the sealing pipe connection and away from it.

26 Claims, 5 Drawing Sheets

NOZZLE ASSEMBLY FOR A HIGH-PRESSURE CLEANING DEVICE

This application is a continuation of International application No. PCT/EP2003/012687 filed on Nov. 13, 2003.

The present disclosure relates to the subject matter disclosed in International application No. PCT/EP2003/012687 of Nov. 13, 2003 and German application number 102 57 783.8 of Dec. 11, 2002, which are incorporated herein by reference in their entirety and for all purposes.

BACKGROUND OF THE INVENTION

The invention relates to a nozzle assembly for a high-pressure cleaning device or a similar device with a low-pressure nozzle, a high-pressure nozzle arranged therein, a spray lance which bears a sealing pipe connection which can be inserted into the high-pressure nozzle, a bypass bypassing the high-pressure nozzle and leading to the low-pressure nozzle and displacement elements which alter the distance between the sealing pipe connection and the high-pressure nozzle in such a manner that the sealing pipe connection abuts sealingly on the high-pressure nozzle in a high-pressure position and, as a result, interrupts the connection from the spray lance to the bypass whereas the sealing pipe connection is at a distance from the high-pressure nozzle in the low-pressure position and, as a result, releases the connection from the spray lance to the bypass.

In the case of high-pressure cleaning devices, there are various known constructions for selectively discharging the liquid conveyed from the high-pressure cleaning device, via a spray lance, via a high-pressure nozzle, a low-pressure nozzle or a combination of the two nozzles and so the properties of the spray jet can essentially be continuously adjusted between high-pressure spray jet and low-pressure spray jet. For example, it is known from EP 0 146 795 to keep the nozzles in the respective switching position by means of the liquid pressure in the case of a variable nozzle for high-pressure cleaning devices. With this construction, the high-pressure nozzle insert is rigidly connected to the spray lance.

EP 0 501 164 A1 describes a one-part nozzle body, in which a central high-pressure nozzle opening and low-pressure nozzle openings arranged parallel thereto are provided. The nozzle body may be displaced in relation to the supply pipe; this dips into the high-pressure nozzle piece in an advanced position; the sealing is brought about via O-ring seals on the insertable supply pipe connection.

DE 196 13 391 A1 discloses a further nozzle assembly, with which a high-pressure and a low-pressure insert are displaced together and, as a result, close or release bypasses for the low-pressure spray jet. In the case of this known spray nozzle, the high-pressure and the low-pressure inserts must be mounted on the spray lance via a thread and be turned in relation to it for their displacement.

In all the known constructions, additional structures result which require considerable constructional resources and are, in many cases, complicated and so many parts are necessary which have to be processed in a special way in order to fulfill the complicated adjustment functions.

Proceeding from this state of the art, the object underlying the subject matter of the application is to design a nozzle assembly of the generic type such that its construction is considerably simplified, in particular, its assembly, as well.

SUMMARY OF THE INVENTION

This object is accomplished in accordance with the invention, in a nozzle assembly of the type described at the outset, in that the spray lance bears a pot-shaped housing which surrounds the sealing pipe connection and in which the low-pressure nozzle and the high-pressure nozzle are mounted so as to be freely displaceable and sealed in relation to the inner wall of the housing, and that the displacement elements displace the low-pressure nozzle and the high-pressure nozzle in the housing in its longitudinal direction towards the sealing pipe connection and away from it.

With this solution, the spray lance bears a pot-shaped housing which serves as bearing for the constructional unit consisting of low-pressure nozzle and high-pressure nozzle; this constructional unit is simply pushed into the housing from the front and displaced in the housing towards the sealing pipe connection to a greater or lesser extent by means of the displacement movement. This is possible in a simple manner and the assembling of such an assembly is also very simple since only the constructional unit consisting of high-pressure and low-pressure nozzles has to be pushed into the pot-shaped housing; in addition, only the displacement element, which displaces the constructional unit consisting of low-pressure nozzle and high-pressure nozzle in the pot-shaped housing, need be fixed in position on the spray lance.

It is favorable when the low-pressure nozzle is secured against any rotation about the longitudinal axis of the housing by means of an element preventing rotation.

A particularly preferred embodiment results when the displacement elements comprise a sleeve which surrounds the pot-shaped housing, is displaceable on the housing in an axial direction and thereby bears a stop surface pushing the low-pressure nozzle into the housing to a greater or lesser depth.

The sleeve may, in particular, be mounted on the housing so as to be rotatable via a thread.

In this respect, it is advantageous when the sleeve is made up of two half shells which can be placed against the housing from both sides.

A further, favorable development results when the high-pressure nozzle is pushed into the interior of the low-pressure nozzle from the rear side and when stop elements are provided which limit the depth of insertion of the high-pressure nozzle into the low-pressure nozzle. The constructional unit consisting of high-pressure nozzle and low-pressure nozzle is therefore obtained simply by the high-pressure nozzle being pushed into the low-pressure nozzle from the rear side; in the inserted position it is held by the pressure of the liquid and fixing elements, in particular, are not required.

The bypass may be formed in accordance with a preferred embodiment by longitudinal channels in the inner wall of the interior of the low-pressure nozzle which are open towards the interior and are closed towards the interior by the outer wall of the inserted high-pressure nozzle. This also results in a constructionally very simple solution; the longitudinal channels, which can be formed by means of longitudinal ribs on the inner side of the interior, are, alone, sufficient to form, together with the inserted high-pressure nozzle, flow channels for the bypass which extend in longitudinal direction.

The longitudinal channels may be in communication with the interior of the pot-shaped housing via lateral openings in the wall of the low-pressure nozzle.

In this case, as well, it is advantageous when the high-pressure nozzle is secured against any rotation about the longitudinal axis of the housing by an element preventing rotation.

In a particularly preferred embodiment, it is provided, in addition, for the sealing pipe connection to abut in the high-pressure position on a sealing surface of the high-pressure nozzle, which surrounds the sealing pipe connection, with an annular sealing section which is expanded elastically due to the effect of the pressure of the liquid conveyed and is pressed sealingly against the surrounding sealing surface.

In this way, the inherent elasticity of the sealing section is utilized to bring about a sealing of the sealing pipe connection in relation to the interior of the high-pressure nozzle when the high-pressure nozzle is in the high-pressure position. Additional sealing elements are not necessary; in particular, O-ring seals can be dispensed with at this point. As a result, the construction of the entire assembly is also simplified quite considerably.

The construction described may be realized particularly advantageously in the case of the inventive configuration of a nozzle assembly; this type of sealing may, however, also be used for other assemblies, with which a seal between a spray lance, on the one hand, and a nozzle body, on the other hand, must be provided. This type of sealing can, in particular, also be used when a generic nozzle assembly of the type described at the outset is used, with which high-pressure nozzle and low-pressure nozzle are of a different design and the switching over from high-pressure nozzle to low-pressure nozzle is brought about in a different way.

In the case of such an assembly with sealing between sealing pipe connection and high-pressure nozzle due to elastic expansion of the annular sealing section, it is advantageous when the sealing section at least consists of an elastically deformable plastic material. It is possible for the entire spray lance to be produced in this way from the same plastic material.

In order to achieve the required elasticity in the area of the sealing section, it may be advantageous when the sealing section has a reduced wall thickness in comparison with the wall thickness of the spray lance.

The sealing section is, in particular, of a circular cylindrical design.

The sealing surface of the high-pressure nozzle is also preferably of a circular cylindrical design.

It is favorable when a sealing area narrowing in cross section adjoins the sealing surface of the high-pressure nozzle in the direction of flow; this can be, in particular, of a conical design. This sealing area narrowing in cross section results in a first sealing between sealing pipe connection and high-pressure nozzle when these are brought closer to one another. This first sealing causes the pressure of the liquid conveyed to increase in the interior of the high-pressure nozzle since the bypass is to a great extent closed. This increase in pressure then leads to a complete sealing due to elastic expansion of the sealing section.

In accordance with a preferred embodiment, it is provided for the high-pressure nozzle to have an elastic expanding capability in the area of the sealing surface which is considerably less than that of the sealing section of the spray lance.

For example, the high-pressure nozzle may have a wall thickness in the area of the sealing surface which is increased in relation to the remaining wall areas.

It is also possible for the high-pressure nozzle to consist of a metal or a plastic with low elasticity, for example, of brass or of a particularly viscous polyamide, at least in the area of the sealing surface.

The following description of preferred embodiments of the invention serves to explain the invention in greater detail in conjunction with the drawings.

DETAILED DESCRIPTION OF THE INVENTION

Figure 1:
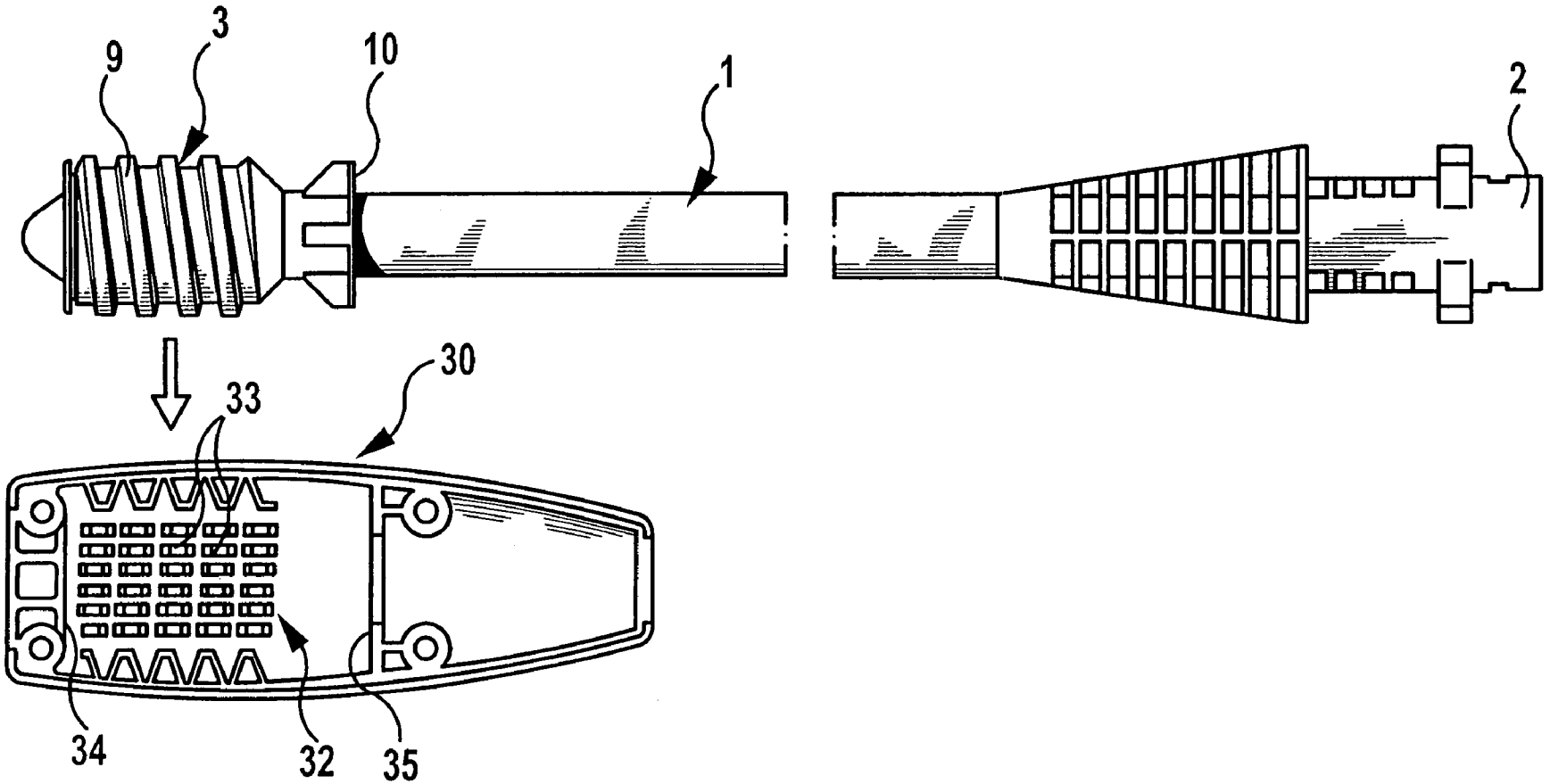
FIG. 1: shows a side view of a spray lance with actuating sleeve removed.
Figure 2:
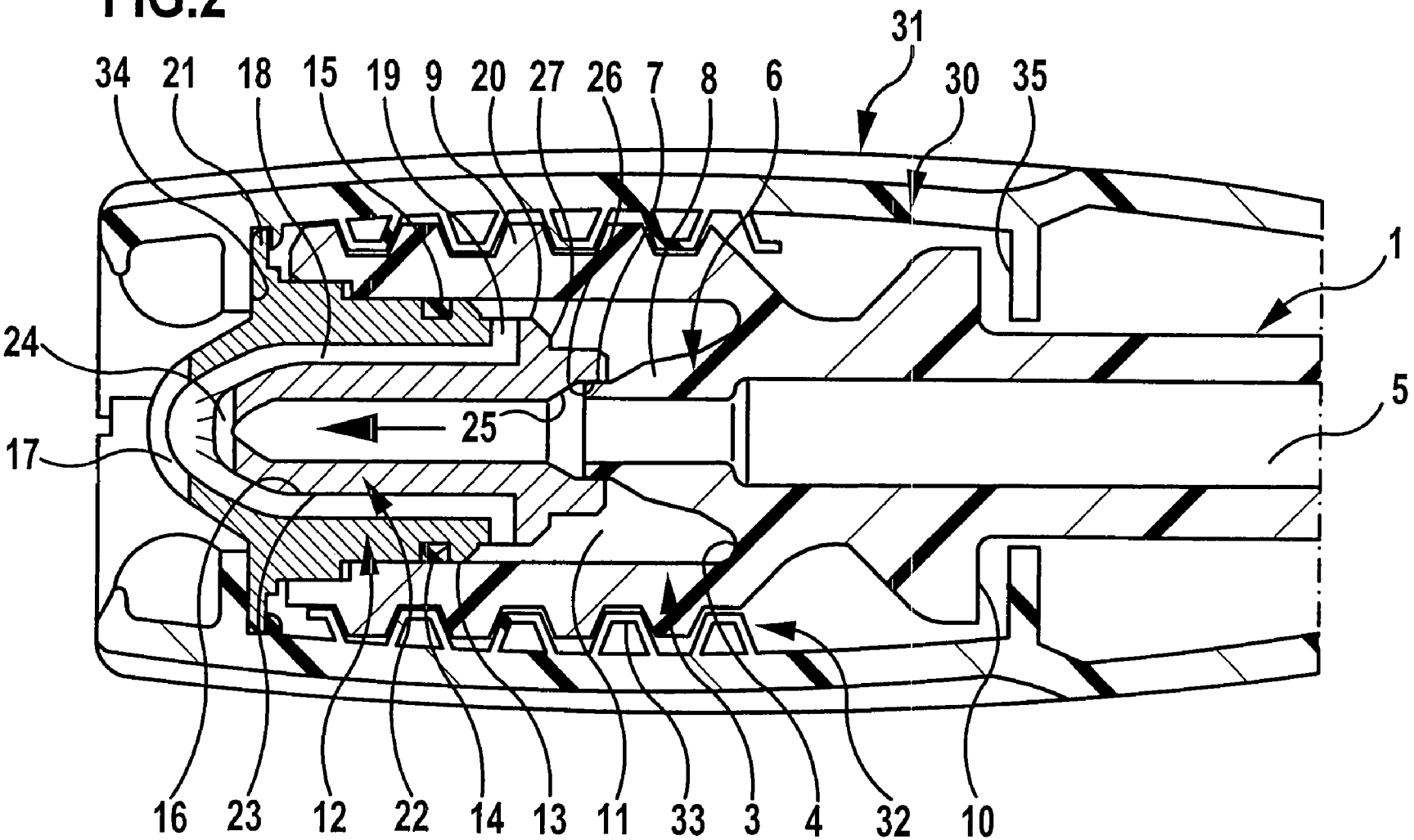
FIG. 2: shows a longitudinal sectional view through a nozzle assembly during high-pressure operation.
Figure 3:
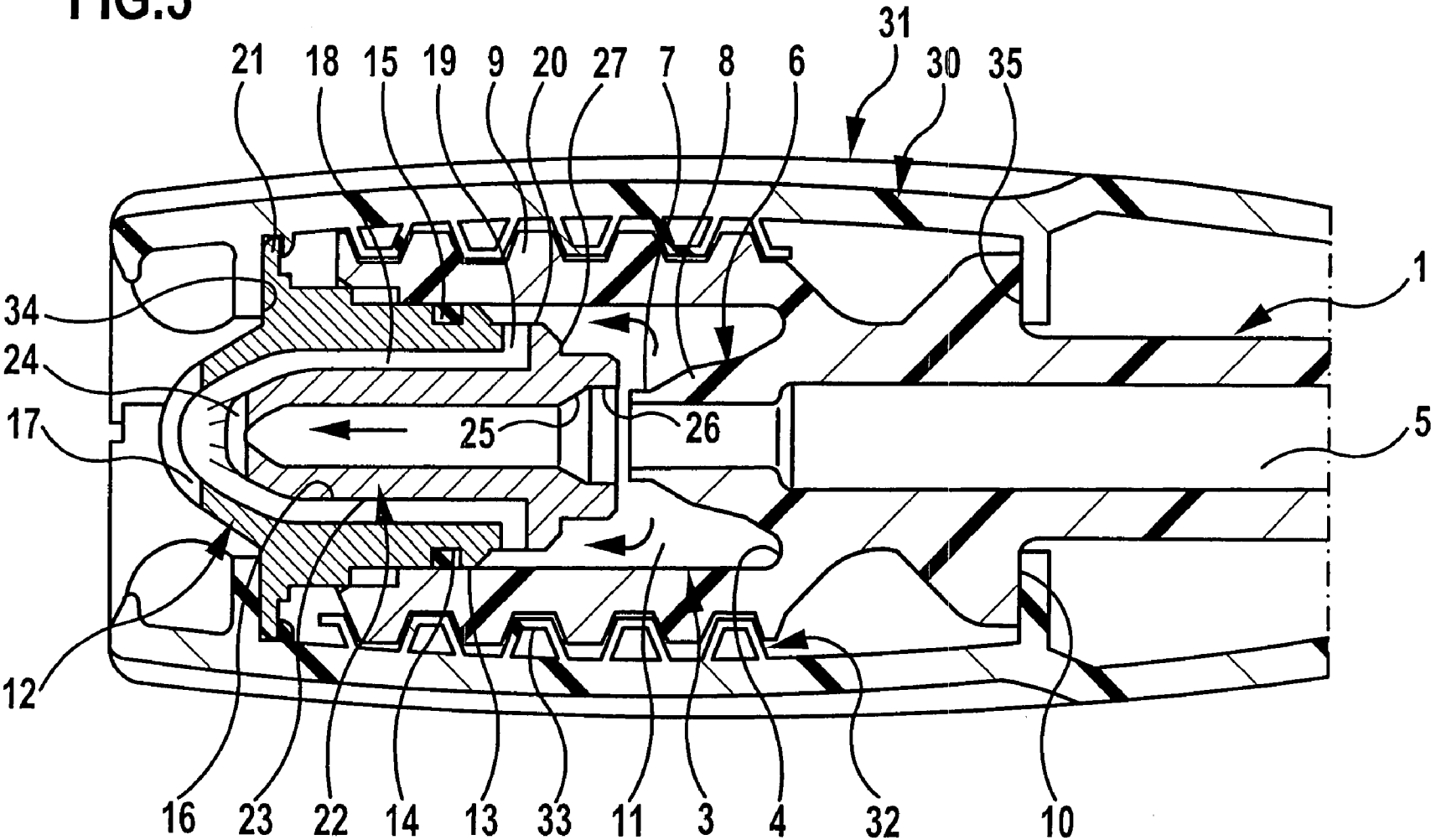
FIG. 3: shows a view similar to FIG. 2 during low-pressure operation.

The nozzle assembly illustrated in the drawings comprises a spray lance 1 which bears at one end a connection 2 in the form of a bayonet, with which the spray lance 1 can be connected to a supply line which is not illustrated in the drawings and which, for its part, is fed from a high pressure cleaning device which is known per se and likewise not illustrated. At the end located opposite the connection 2, the spray lance 1 is provided with a pot-shaped housing 3 which is arranged concentrically to the spray lance, has a closed base 4 towards the spray lance and is open on the oppositely located side. The interior of the housing 3 has an essentially circular cylindrical cross section, the diameter of which is greater than the diameter of the spray lance 1.

The interior 5 of the spray lance 1 is in communication with a sealing pipe connection 6 which projects out of the base 4 in the center thereof and bears at its free end a thin-walled, circular cylindrical sealing section 7. The wall section 8 adjoining the sealing section 7 in the direction towards the spray lance 1 has a considerably greater wall thickness than the sealing section 7; this also applies for the spray lance 1 as a whole. In addition, this is produced from a plastic material which is elastically deformable to a slight extent, for example, from polyphthalamide (PPA), polyphenylene sulfide (PPS), polyacryl ether ketones (PEEK), polyamide (PA) or polyethylene terephthalate (PET). These plastic materials may also be reinforced, for example, by glass fibers; in this respect, a proportion of glass fibers of 10 to 50, in particular, about 30% is favorable.

On its outer side the pot-shaped housing 3 bears an external thread 9 which extends over the entire height of the housing 3 and outwardly projecting stop elements 10 are integrally formed on the outer side of the spray lance 1 at a slight distance from the base 4.

A low-pressure nozzle 12 is pushed into the circular cylindrical interior 11 of the pot-shaped housing 3 from its open front side and this has essentially a circular cylindrical outer wall 13, the external diameter of which corresponds essentially to the internal diameter of the cylindrical interior 11 of the housing 3. In this area, the outer wall 13 bears an annular seal 15 in a circumferential groove 14 so that the low-pressure nozzle 12 is sealed in relation to the inner wall of the housing 3. The interior 16 of the low-pressure nozzle 12 is likewise of a circular cylindrical design; at the front end of the low-pressure nozzle 12 facing away from the spray lance 1 the interior 16 is closed in a dome shape and has at this point a larger outlet opening 17 whereas the interior 16 is open on the oppositely located side. Channels 18, which extend in a longitudinal direction, are open towards the interior 16 and extend essentially over the entire length of the cylindrical interior as far as the end closed in a dome shape, are incorporated into the inner wall. These channels 18 end at their end facing the spray lance 1 in passages 19 which are directed radially outwards; in the area of these passages 19, the external diameter of the low-pressure nozzle 12 is slightly smaller than the internal diameter of the interior 11 of the housing 3 so that, in this area, the inserted low-pressure nozzle 12 is surrounded by an annular gap 20 which is limited, on the one hand, by the annular seal 15 and, on the other hand, by the base 4 of the housing 3. This annular gap 20 is in communication with the channels 18 on the inner side of the low-pressure nozzle 12 via the passages 19.

A radially projecting flange 21, which is arranged outside the pot-shaped housing 3 and has a greater external diameter than the interior 11 of this housing 3, is integrally formed on the low-pressure nozzle 12 at its end bearing the outlet opening 17.

Figure 5:
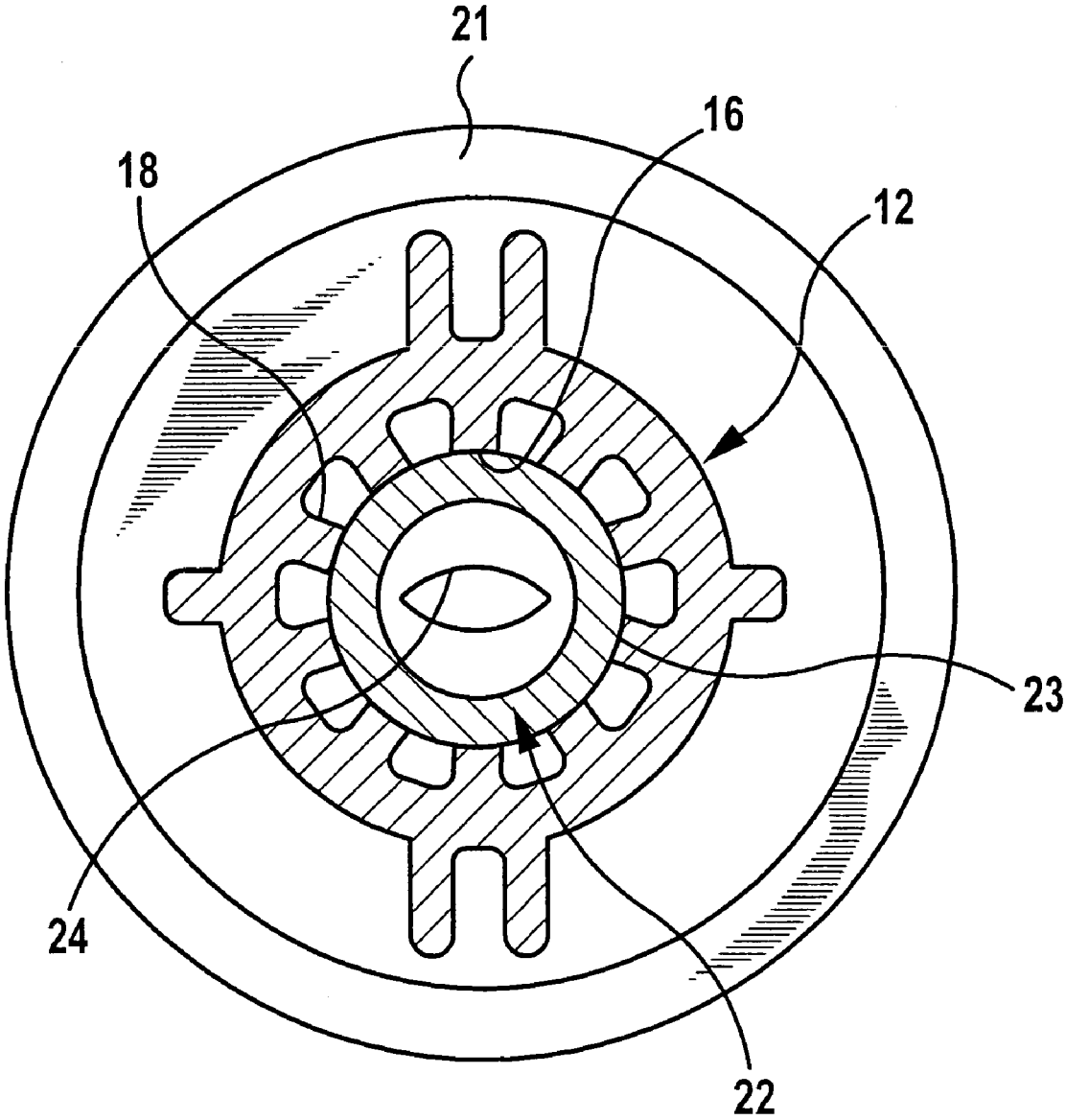
FIG. 5: shows a sectional view along line 5-5 in FIG. 4.

A high-pressure nozzle 22 is pushed into the interior 16 from the open rear side thereof and has an essentially circular cylindrical outer wall 23, the external diameter of which corresponds to the internal diameter of the interior 16 of the low-pressure nozzle 12 so that when the high-pressure nozzle 22 is inserted it closes the channels 18 open towards the interior 16 of the low-pressure nozzle 12 (FIG. 5). The high-pressure nozzle 22 is closed at one end in a dome shape and has at this end an outlet opening 24, the exit cross section of which is smaller than the exit cross section of the outlet opening 17 of the low-pressure nozzle 12; on the oppositely located side the high-pressure nozzle 22 is open and widens at this point via a conical sealing step 25 and merges upstream of this sealing step 25 into a circular cylindrical sealing surface 26.

Figure 4:
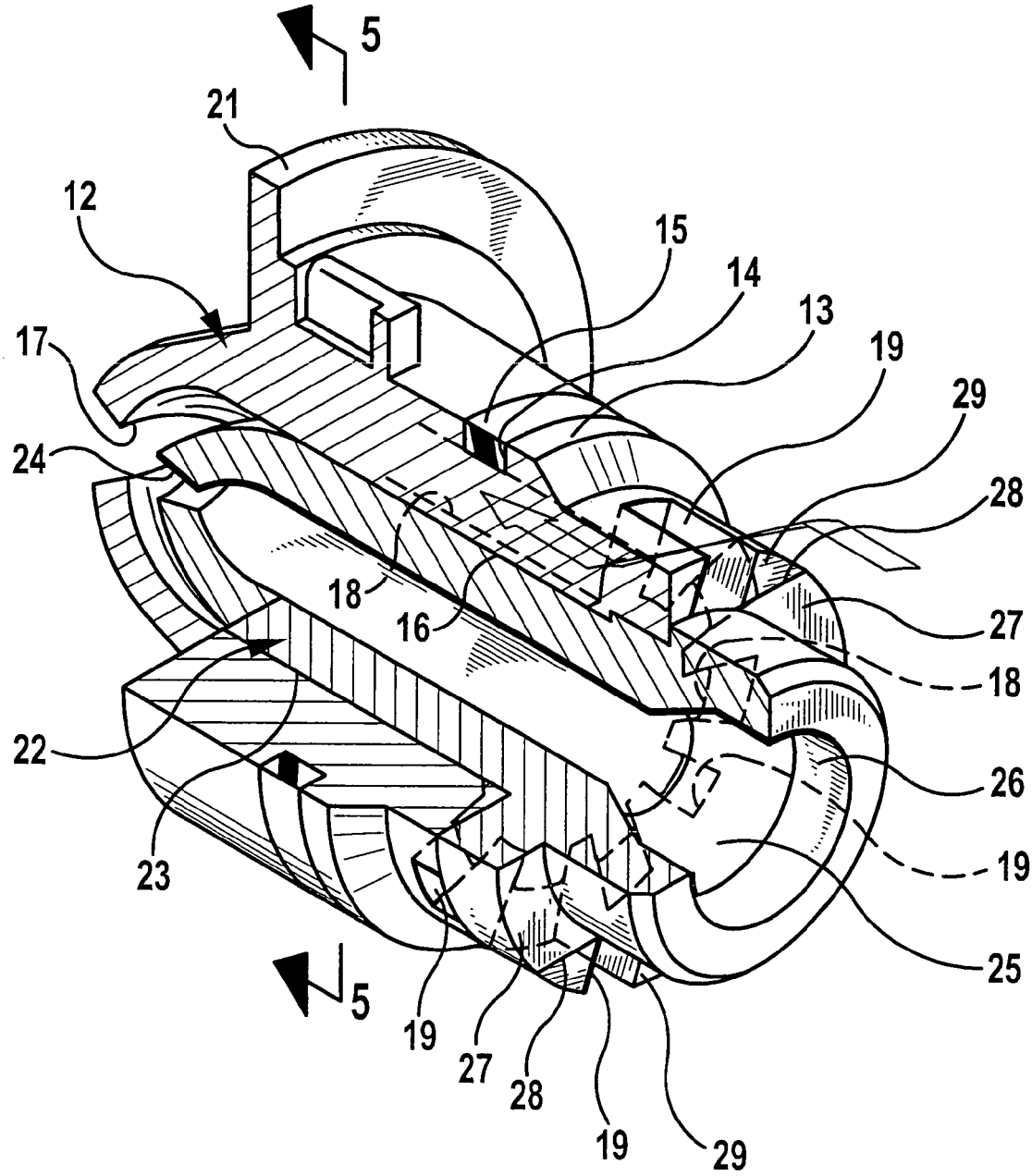
FIG. 4: shows a perspective view of a constructional unit consisting of low-pressure nozzle and high-pressure nozzle partially cut open

The depth of insertion of the high-pressure nozzle 22 into the interior 16 of the low-pressure nozzle 12 is limited by an annular flange 27 which abuts on the rearward end of the low-pressure nozzle 12 when the high-pressure nozzle 22 is inserted completely. In this respect, this annular flange 27 is flattened at oppositely located ends; the flattened areas 28 resulting therefrom are covered by rearward extensions 29 of the low-pressure nozzle 12 so that, as a result, the high-pressure nozzle 22 is accommodated in the low-pressure nozzle 12 in a manner secured against rotation (FIG. 4).

The pot-shaped housing 3, the low-pressure nozzle 12 arranged therein and the high-pressure nozzle 22 inserted into it are surrounded by two half shells 30 which together form a sleeve 31 when they are connected to one another, for example, by screws, surrounding the remaining components. On their inner sides, the half shells 30 bear thread turns 32 in the form of projections 33 which are arranged next to one another and project inwardly; these projections 33 dip into the thread turns of the external thread 9 so that when the sleeve 31 is turned it is displaced in longitudinal direction of the spray lance.

On their inner sides, the two half shells 30 bear two inwardly projecting annular flanges 34 and 35; the forward annular flange 34 abuts on the outer side of the flange 21 whereas the rearward annular flange 35 engages behind the stop elements 10 of the spray lance 1. The dimensioning is selected such that the sleeve 31 is adjustable only over a relatively small angular range and, in this respect, performs a displacement of only a few millimeters; this displacement is limited, on the one hand, by the fact that the annular flange 35 abuts on the stop elements 10 and, on the other hand, due to the fact that the low-pressure nozzle 12 cannot be inserted further into the housing 3.

In a first position, which is designated in the following as low-pressure position, the sleeve 31 is turned such that it abuts with the annular flange 35 on the stop elements 10; in this position of the sleeve 31 the low-pressure nozzle 12 and the high-pressure nozzle 22 accommodated therein can be pushed out of the housing 3 to a maximum due to the effect of the liquid which is conveyed through the spray lance 1 and is subject to high pressure and so a space remains between the sealing pipe connection 6 and the sealing surface 26 of the high-pressure nozzle 22, through which the liquid exiting from the spray lance 1 can enter the annular gap 20. The liquid therefore has two flow paths available, namely a first flow path through the high-pressure nozzle 22 to the outlet opening 24 and a second flow path through the annular gap 20, the passages 19 and the channels 18 to the outlet opening 17 of the low-pressure nozzle 12. On account of the relatively large exit cross section of the two outlet openings, the liquid exits with a relatively low pressure.

In the other end position, which is designated in the following as high-pressure position, the sleeve 31 is turned to such an extent that the low-pressure nozzle 12 and also, therefore, the high-pressure nozzle 22 accommodated in it are pushed into the housing 3 to a maximum via the annular flange 34. During this insertion, the sealing pipe connection 6 enters the open end of the high-pressure nozzle 22 with its sealing section 7 and abuts first of all on the conical sealing step 25 so that the flow communication to the annular gap 20 is interrupted but, without any intermediate layer of a seal, possibly not completely. Nevertheless, this sealing is sufficient to increase the pressure in the interior of the high-pressure nozzle 22 and this increase in pressure leads to the circular cylindrical, thin-walled sealing section 7 being pressed elastically outwards; in this respect, it abuts sealingly on the surrounding sealing surface 26 of the high-pressure nozzle 22 and, in this way, a complete sealing is brought about which manages without any intermediate layer of a sealing ring and also compensates without any problem for production tolerances. The liquid can, therefore, exit only through the high-pressure nozzle 22 and the outlet opening 24; the outlet cross section of the outlet opening 24 is relatively small; the exiting spray jet is, therefore, a high-pressure spray jet.

Between these two end positions, optional intermediate positions are possible, with which a larger or smaller proportion of the exiting liquid is discharged through the outlet opening 17 via the annular gap 20 and the channels 18.

The construction of the assembly described is very simple; in particular, considerable advantages result therefrom during the assembling. During the assembling, it is namely sufficient to push the high-pressure nozzle 22 first of all into the interior 16 of the low-pressure nozzle 12; in this respect, a tool is not necessary nor are seals required. Subsequently, the low-pressure nozzle 12 is pushed into the housing 3 from the front; the sealing is ensured in this case via only one annular seal. This assembly is then surrounded by the two half shells 30 which are placed against the housing 3 from outside and connected to one another. Additional assembly steps are not necessary and also the number of individual parts used is extremely small.

The invention claimed is:

1. Nozzle assembly for a high-pressure cleaning device, comprising:

a low-pressure nozzle, a high-pressure nozzle arranged within the low pressure nozzle, a spray lance having a first end adapted for connection to a supply line and a second end bearing a sealing pipe connection insertable into the high-pressure nozzle, a bypass bypassing the high-pressure nozzle and leading to the low-pressure nozzle, a pot-shaped housing arranged on the second end of the spray lance and surrounding the sealing pipe connection, and displacement elements displaceable to alter the distance between the sealing pipe connection and the high-pressure nozzle to provide a high-pressure position in which the sealing pipe connection abuts sealingly on the high-pressure nozzle and interrupts a connection between the spray lance and the bypass and a low-pressure position in which the sealing pipe connection is at a distance from the high-pressure nozzle and establishes the connection between the spray lance and the bypass, the low-pressure nozzle and the high-pressure nozzle being mounted in said pot-shaped housing so as to be freely displaceable and sealed in relation to an inner wall of the pot-shaped housing, wherein;

the displacement elements displace the low-pressure nozzle and the high-pressure nozzle in the housing in a longitudinal direction of the housing towards the sealing pipe connection in the high-pressure position and away from the sealing pipe connection in the low-pressure position, the high-pressure nozzle is pushable into an interior of the low-pressure nozzle from a rear side, stop elements are provided, said stop elements limiting a depth of insertion of the high-pressure nozzle into the low-pressure nozzle, and the bypass comprises longitudinal channels formed between an inner wall of the interior of the low-pressure nozzle an outer wall of the inserted high-pressure nozzle.

2. Nozzle assembly as defined in claim 1, wherein the low-pressure nozzle is secured against rotation about a longitudinal axis of the housing by means of an element preventing rotation.

3. Nozzle assembly as defined in claim 1, wherein the displacement elements comprise a sleeve surrounding the pot-shaped housing, said sleeve being displaceable in an axial direction on the housing and bearing a stop surface adapted for pushing the low-pressure nozzle into the housing to a greater or lesser depth.

4. Nozzle assembly as defined in claim 3, wherein the sleeve is mounted on the housing so as to be rotatable via a thread.

5. Nozzle assembly as defined in claim 3, wherein:

the high-pressure nozzle is pushable into an interior of the low-pressure nozzle from a rear side, and stop elements are provided, said stop elements limiting a depth of insertion of the high-pressure nozzle into the low-pressure nozzle.

6. Nozzle assembly as defined in claim 3, wherein in the high-pressure position the sealing pipe connection abuts on a sealing surface of the high-pressure nozzle surrounding the sealing pipe connection with an annular sealing section, said sealing section being expandable elastically due to an effect of a pressure of liquid conveyed and being pressed sealingly against the surrounding sealing surface.

7. Nozzle assembly as defined in claim 1, wherein the longitudinal channels are in communication with an interior of the pot-shaped housing via lateral openings in the wall of the low-pressure nozzle.

8. Nozzle assembly as defined in claim 1, wherein in the high-pressure position the sealing pipe connection abuts on a sealing surface of the high-pressure nozzle surrounding the sealing pipe connection with an annular sealing section, said sealing section being expandable elastically due to an effect of a pressure of liquid conveyed and being pressed sealingly against the surrounding sealing surface.

9. Nozzle assembly as defined in claim 8, wherein the sealing section has a reduced wall thickness in comparison with a wall thickness of the spray lance.

10. Nozzle assembly as defined in claim 8, wherein the sealing section is cylindrical with a circular cross-section.

11. Nozzle assembly as defined in claim 8, wherein the sealing surface of the high-pressure nozzle is cylindrical with a circular cross-section.

12. Nozzle assembly as defined in claim 11, wherein a sealing area of the high-pressure nozzle which narrows in cross section adjoins the sealing surface of the high-pressure pressure nozzle in a direction downstream of a flow of liquid through the nozzle assembly.

13. Nozzle assembly as defined in claim 8, wherein the high-pressure nozzle has an elastic expandability in an area of the sealing surface which is considerably less than an elastic expandability of the sealing section of the spray lance.

14. Nozzle assembly as defined in claim 13, wherein in the area of the sealing surface the high-pressure nozzle has a wall thickness which is greater than a wall thickness of remaining wall areas of the high-pressure nozzle.

15. Nozzle assembly as defined in claim 14, wherein the high-pressure nozzle consists of one of a metal or a plastic with low elasticity at least in the area of the sealing surface.

16. Nozzle assembly as defined in claim 13, wherein the high-pressure nozzle consists of one of a metal or a plastic with low elasticity at least in the area of the sealing surface.

17. Nozzle assembly for a high-pressure cleaning device, comprising:

a low-pressure nozzle, a high-pressure nozzle arranged within the low pressure nozzle, a spray lance having a first end adapted for connection to a supply line and a second end bearing a sealing pipe connection insertable into the high-pressure nozzle, a bypass bypassing the high-pressure nozzle and leading to the low-pressure nozzle, a pot-shaped housing arranged on the second end of the spray lance and surrounding the sealing pipe connection, and displacement elements displaceable to alter the distance between the sealing pipe connection and the high-pressure nozzle to provide a high-pressure position in which the sealing pipe connection abuts sealingly on the high-pressure nozzle and interrupts a connection between the spray lance and the bypass and a low-pressure position in which the sealing pipe connection is at a distance from the high-pressure nozzle and establishes the connection between the spray lance and the bypass, the low-pressure nozzle and the high-pressure nozzle being mounted in said pot-shaped housing so as to be freely displaceable and sealed in relation to an inner wall of the pot-shaped housing, wherein:

the displacement elements displace the low-pressure nozzle and the high-pressure nozzle in the housing in a longitudinal direction of the housing towards the sealing pipe connection in the high-pressure position and away from the sealing pipe connection in the low-pressure position, the high-pressure nozzle is pushable into an interior of the low-pressure nozzle from a rear side, stop elements are provided, said stop elements limiting a depth of insertion of the high-pressure nozzle into the low-pressure nozzle, and the high-pressure nozzle is secured against rotation about a longitudinal axis of the housing by means of an element preventing rotation.

18. Nozzle assembly for a high-pressure cleaning device, comprising:

a low-pressure nozzle, a high-pressure nozzle arranged within the low pressure nozzle, a spray lance having a first end adapted for connection to a supply line and a second end bearing a sealing pipe connection insertable into the high-pressure nozzle, a bypass bypassing the high-pressure nozzle and leading to the low-pressure nozzle, a pot-shaped housing arranged on the second end of the spray lance and surrounding the sealing pipe connection, and displacement elements displaceable to alter the distance between the sealing pipe connection and the high-pressure nozzle to provide a high-pressure position in which the sealing pipe connection abuts sealingly on the high-pressure nozzle and interrupts a connection between the spray lance and the bypass and a low-pressure position in which the sealing pipe connection is at a distance from the high-pressure nozzle and establishes the connection between the spray lance and the bypass, the low-pressure nozzle and the high-pressure nozzle being mounted in said pot-shaped housing so as to be freely displaceable and sealed in relation to an inner wall of the pot-shaped housing, wherein:

the displacement elements displace the low-pressure nozzle and the high-pressure nozzle in the housing in a longitudinal direction of the housing towards the sealing pipe connection in the high-pressure position and away from the sealing pipe connection in the low-pressure position, in the high-pressure position the sealing pipe connection abuts on a sealing surface of the high-pressure nozzle surrounding the sealing pipe connection with an annular sealing section, said sealing section being expandable elastically due to an effect of a pressure of liquid conveyed and being pressed sealingly against the surrounding sealing surface, and the sealing section at least consists of an elastically deformable plastic material.

19. Nozzle assembly as defined in claim 18, wherein:

the high-pressure nozzle is pushable into an interior of the low-pressure nozzle from a rear side, and stop elements are provided, said stop elements limiting a depth of insertion of the high-pressure nozzle into the low-pressure nozzle.

20. Nozzle assembly as defined in claim 19, wherein:

the bypass comprises longitudinal channels formed between an inner wall of the interior of the low-pressure nozzle an outer wall of the inserted high-pressure nozzle.

21. Nozzle assembly as defined in claim 18, wherein the sealing section has a reduced wall thickness in comparison with a wall thickness of the spray lance.

22. Nozzle assembly as defined in claim 18, wherein the sealing section is cylindrical with a circular cross-section.

23. Nozzle assembly as defined in claim 18, wherein a sealing area of the high-pressure nozzle which narrows in cross section adjoins the sealing surface of the high-pressure nozzle in a direction downstream of a flow of liquid through the nozzle assembly.

24. Nozzle assembly as defined in claim 18, wherein the high-pressure nozzle has an elastic expandability in an area of the sealing surface which is considerably less than an elastic expandability of the sealing Section of the spray lance.

25. Nozzle assembly for a high-pressure cleaning device, comprising:

a low-pressure nozzle, a high-pressure nozzle arranged within the low pressure nozzle, a spray lance having a first end adapted for connection to a supply line and a second end bearing a sealing pipe connection insertable into the high-pressure nozzle, a bypass bypassing the high-pressure nozzle and leading to the low-vressure nozzle, a pot-shaped housing arranged on the second end of the spray lance and surrounding the sealing pipe connection, and displacement elements displaceable to alter the distance between the sealing pipe connection and the high-pressure nozzle to provide a high-pressure position in which the sealing pipe connection abuts sealingly on the high-pressure nozzle and interrupts a connection between the spray lance and the bypass and a low-pressure position in which the sealing pipe connection is at a distance from the high-pressure nozzle and establishes the connection between the spray lance and the bypass, the low-pressure nozzle and the high-pressure nozzle being mounted in said pot-shaped housing so as to be freely displaceable and sealed in relation to an inner wall of the pot-shaped housing, wherein:

the displacement elements displace the low-pressure nozzle and the high-pressure nozzle in the housing in a longitudinal direction of the housing towards the sealing pipe connection in the high-pressure position and away from the sealing pipe connection in the low-pressure position, in the high-pressure position the sealing pipe connection abuts on a sealing surface of the high-pressure nozzle surrounding the sealing pipe connection with an annular sealing section, said sealing section being expandable elastically due to an effect of a pressure of liquid conveyed and being pressed sealingly against the surrounding sealing surface, and a sealing area of the high-pressure nozzle which narrows in cross section adjoins the sealing surface of the high-pressure nozzle in a direction downstream of a flow of liquid through the nozzle assembly.

26. Nozzle assembly as defined in claim 25, wherein the sealing area narrowing in cross section is of a conical design.

* * * * *